US008272452B2

(12) United States Patent
Katou et al.

(10) Patent No.: US 8,272,452 B2
(45) Date of Patent: Sep. 25, 2012

(54) HAMMERING TOOL

(75) Inventors: Kouji Katou, Tokyo (JP); Terufumi Hamano, Tokyo (JP); Yoshitaka Otsuka, Tokyo (JP); Akira Teranishi, Tokyo (JP); Kazuya Sakamaki, Tokyo (JP)

(73) Assignee: Max Co., Ltd., Tokyo (JP)

( * ) Notice: Subject to any disclaimer, the term of this patent is extended or adjusted under 35 U.S.C. 154(b) by 323 days.

(21) Appl. No.: 12/602,870

(22) PCT Filed: May 23, 2008

(86) PCT No.: PCT/JP2008/059570

§ 371 (c)(1),
(2), (4) Date: Dec. 3, 2009

(87) PCT Pub. No.: WO2008/149695

PCT Pub. Date: Dec. 11, 2008

(65) Prior Publication Data

US 2011/0024146 A1 Feb. 3, 2011

(30) Foreign Application Priority Data

Jun. 5, 2007 (JP) ..... 2007-149431

(51) Int. Cl.
*B25D 11/04* (2006.01)

(52) U.S. Cl. ..... 173/2; 173/176; 173/201; 173/217

(58) Field of Classification Search ..... 173/2, 176, 173/218, 201, 217, 179, 181, 178, 216; 73/862.21, 73/862.23; 318/432
See application file for complete search history.

(56) References Cited

U.S. PATENT DOCUMENTS

| | | | | | |
|---|---|---|---|---|---|
| 5,154,242 | A * | 10/1992 | Soshin et al. | ..... | 173/178 |
| 5,170,358 | A * | 12/1992 | Delio | ..... | 700/177 |
| 5,353,882 | A * | 10/1994 | Inoue et al. | ..... | 173/176 |
| 5,731,673 | A * | 3/1998 | Gilmore | ..... | 318/432 |
| 6,044,918 | A * | 4/2000 | Noser et al. | ..... | 173/176 |
| 6,190,098 | B1 * | 2/2001 | Fujita et al. | ..... | 409/132 |
| 6,484,814 | B2 | 11/2002 | Bongers-Ambrosius | | |
| 6,814,152 | B2 * | 11/2004 | Ginell | ..... | 173/2 |
| 7,155,986 | B2 * | 1/2007 | Kawai et al. | ..... | 73/862.21 |
| 7,334,648 | B2 * | 2/2008 | Arimura | ..... | 173/179 |
| 2005/0230130 | A1 | 10/2005 | Strasser et al. | | |

FOREIGN PATENT DOCUMENTS

| | | | |
|---|---|---|---|
| CN | 1217770 | C | 9/2005 |
| EP | 1 607 186 | A1 | 12/2005 |
| EP | 1 738 877 | A2 | 1/2007 |

(Continued)

*Primary Examiner* — Scott A. Smith
(74) *Attorney, Agent, or Firm* — Drinker Biddle & Reath LLP

(57) ABSTRACT

A hammering tool includes, within its tool main body, a piston which reciprocates by using a motor as its drive force, a hammering member which carries out its hammering operation in linking with the reciprocating motion of the piston, and an intermediate member which transmits a hammering force of the hammering member to a top end tool mounted on the top end of the tool main body. The tool main body further includes a measuring device which measures a hammering state of the hammering member and a control device which controls the number of rotations of the motor. The control device, according to measurement results of the measuring device, determines the limit number of times of hammering where the hammering member becomes unable to follow the reciprocating motion of the piston, and thus controls the number of rotations of the motor.

8 Claims, 4 Drawing Sheets

FOREIGN PATENT DOCUMENTS

| | | |
|---|---|---|
| GB | 2 400 811 A | 10/2004 |
| JP | 61-164785 | 7/1986 |
| JP | 2004-195643 | 7/2004 |
| JP | 2005-137134 A | 5/2005 |

* cited by examiner

HAMMERING TOOL

TECHNICAL FIELD

The present invention relates to a hammering tool which transmits the driving force of a hammering member capable of carrying out its driving motion in linking with a piston reciprocating when it is driven by a motor to a top end tool such as a drill bit or a bull point mounted on the top end of a main body of the hammering tool to thereby hole or break concrete or stone. Specifically, the invention relates to an electric hammer, a hammer drill or the like.

BACKGROUND ART

Generally, a hammer drill is structured such that a piston is driven by a motor to reciprocate back and forth on the axis of a top end tool to thereby vary the air pressure of an air chamber formed between the piston and a hammering member; and thus, variations in the air pressure (air spring) are used to allow the hammering member to generate its driving motion. And, the hammer drill transmits the driving force of the hammering member through an intermediate member to the top end tool and also transmits the rotation of the motor through a reduction mechanism such as gears to the top end tool, thereby drilling a hole in concrete or the like. (For example, JP-A-61-164785).

Here, in an operation to drill a hole in the surface of the ceiling, which is one of the main operations of the hammer drill, in order to be able to enhance the efficiency of the drilling operation, the handling of the main body of the tool must be easy and the time necessary for the operation must be short. This demands that the hammer drill is small in size and light in weight as well as is capable of drilling the hole at high speeds.

Generally, to develop a tool which can realize high speed hole drilling, the driving energy of the tool per driving may be increased or the number of rotations of a motor may be increased to thereby increase the number of times of hammering. However, when increasing the driving energy per driving, the mass of the hammering member must be increased and also a driving mechanism portion for driving the hammering member must be increased in size. Accordingly, the size of the main body of the tool is increased, thereby to impair the efficiency of the operation. In view of this, preferably, there may be selected a method which increases the number of rotations of the motor and thus increases the number of times of hammering to thereby increase the hole drilling speed.

However, when the hole drilling speed is increased by increasing the number of times of hammering, at a certain number of times of hammering, the hammering member becomes unable to follow the piston and thus the driving force of the hammering member becomes weaker accordingly, whereby the hole drilling speed is lowered. As described above, in linking with the rotation of the motor, the piston is allowed to reciprocate and thus vary the air pressure of the air chamber, whereby the hammering member is allowed to generate its driving motion. That is, when the reciprocating motion of the piston is too fast, the hammering member is not able to follow the variations in the air pressure, whereby the driving motion of the hammering member is disturbed and thus the driving force of the hammering member is weakened. As the number of times of hammering where a speed balance of the hammering member with respect to the piston starts to lose, there is known the limit number of times of hammering. With the limit number of times of hammering as the boundary, the hole drilling speed is lowered suddenly and heavily, thereby generating so called poor driving.

Thus, the number of rotations of the motor may be lowered in such a manner that the number of times of hammering can be prevented from reaching the limit number of times of hammering. In view of this, there is sold on the market a hammering tool in which, with the variations of the characteristics of motors between the motors taken into consideration, the number of rotations of a motor is set low in order that the number of times of hammering of the hammering tool can be prevented from reaching the limit number of times of hammering.

However, when the number of rotations of the motor is set low so that the number of times of hammering of the hammering tool can be prevented from reaching the limit number of times of hammering, it is not sufficient to take only the variations in the motor characteristics into consideration. That is, the restitution coefficients of colliding parts differ depending on the strength of the concrete, in which a hole is to be drilled, as well as on the mass and shape of the top end tool. Such restitution coefficients are greatly involved with the driving motion of the hammering member; that is, the limit number of times of hammering is different due to the restitution coefficients. Therefore, when these variations are also taken into consideration, the number of times of hammering of the hammering tool when it is designed must be set greatly lower than the limit number of times of hammering.

Also, for a hammering tool of a charging type, during operation, the battery voltage of the motor of the tool decreases and thus the number of rotations of the motor decreases, whereby the number of times of hammering of the tool is lowered greatly from the limit number of times of hammering and thus the driving efficiency of the hammering member is also lowered.

DISCLOSURE OF THE INVENTION

According to one or more embodiments of the invention, there is provided a hammering tool which itself can grasp the limit number of times of hammering in operation and can control a motor so that the rotation of the motor can always provide such number of rotations as near to the limit number of times of hammering of the tool, thereby being able to enhance the efficiency of the hammering operation thereof and also to realize a reduction in the size and weight of the tool.

According to a first aspect of the invention, a hammering tool includes: a tool main body; a motor; a piston which reciprocates by using the motor as a drive force; and a hammering member which carries out its hammering operation in linking with a reciprocating motion of the piston. The tool main body includes a measuring device which measures a driving state of the tool and a control device which controls the number of rotations of the motor. In this hammering tool, the control device controls the number of rotations of the motor according to measurement results of the measuring device.

According to a second aspect of the invention, in the hammering tool, the measuring device measures a drive current value of the motor, and the control device monitors variations in the drive current value and, when the drive current value is lowered, the control device reduces the number of rotations of the motor.

According to a third aspect of the invention, in the hammering tool, the control device samples the drive current value every unit time and monitors variations in the drive current value from a drive current value sampled just before and a drive current value currently sampled.

Further, according to a fourth aspect of the invention, the hammering tool further includes an intermediate member which transmits a hammering force of the hammering member to a top end tool mounted on a top end of the tool main body. The tool main body includes the measuring device which measures a hammering state of the hammering member. The control device, from the measurement results of the measuring device, determines the limit number of times of hammering where the hammering member becomes unable to follow the reciprocating motion of the piston, thereby controlling the number of rotations of the motor.

According to a fifth aspect of the invention, the measuring device measures the value of the drive current of the motor. And, the control device monitors variations in the drive current value and, when the drive current value is lowered, the control device determines that the number of rotations of the motor exceeds the limit number of times of hammering.

According to a sixth aspect of the invention, the control device samples the drive current value every unit time and monitors variations in the drive current value from a drive current value sampled just before and a drive current value currently sampled.

According to a seventh aspect of the invention, the control device increases the number of rotations of the motor until the number of rotations of the motor exceeds the limit number of times of hammering to thereby search the limit number of times of hammering. And, when the number of rotations of the motor exceeds the limit number of times of hammering, the control device reduces the number of rotations of the motor and maintains the number of rotations of the motor just before the limit number of times of hammering; and, when the number of rotations of the motor exceeds the limit number of times of hammering again during the rotation of the motor, the control device corrects the number of rotations of the motor again to thereby search the limit number of times of hammering in such a manner that the number of times of hammering can be always maintained in the vicinity of the limit number of times of hammering.

According to an eighth aspect of the invention, there can be provided a hammering tool which includes: a tool main body; a motor; a piston which reciprocates by using the motor as the drive force thereof; a hammering member which carries out its hammering operation in linking with the reciprocating motion of the piston; an intermediate member which transmits the hammering force of the hammering member to a top end tool mounted on the top end of the tool main body; and, a rotation number adjusting device which sets the number of rotations of the motor. In the hammering tool, the rotation number adjusting device is operated manually.

According to the first aspect of the invention, there can be provided a high-performance hammering tool which, by controlling the number of rotations of the motor in such a manner that the number of times of hammering can be always maintained in the vicinity of the limit number of times of hammering, not only can increase the number of times of hammering up to the limit number to thereby be able to enhance the efficiency of the hammering operation, but also can reduce the size and weight of the tool as well as can provide excellent driving performance.

According to the eighth aspect of the invention, since the limit number of times of hammering can be monitored from the variations in the value of the drive current, the number of rotations of the motor can be controlled in such a manner that the number of times of hammering can be always maintained in the vicinity of the limit number of times of hammering.

According to the third aspect of the invention, since there is provided the rotation number adjusting device which sets the number of rotations of the motor, and also since this rotation number adjusting device is operated manually, it is possible to provide a hammering tool which is low in cost and can provide high efficiency.

The other remaining characteristics and effects of the invention are obvious from the following description of the embodiment of the invention and the appended claims.

BEST MODE FOR CARRYING OUT THE INVENTION

Figure 1:
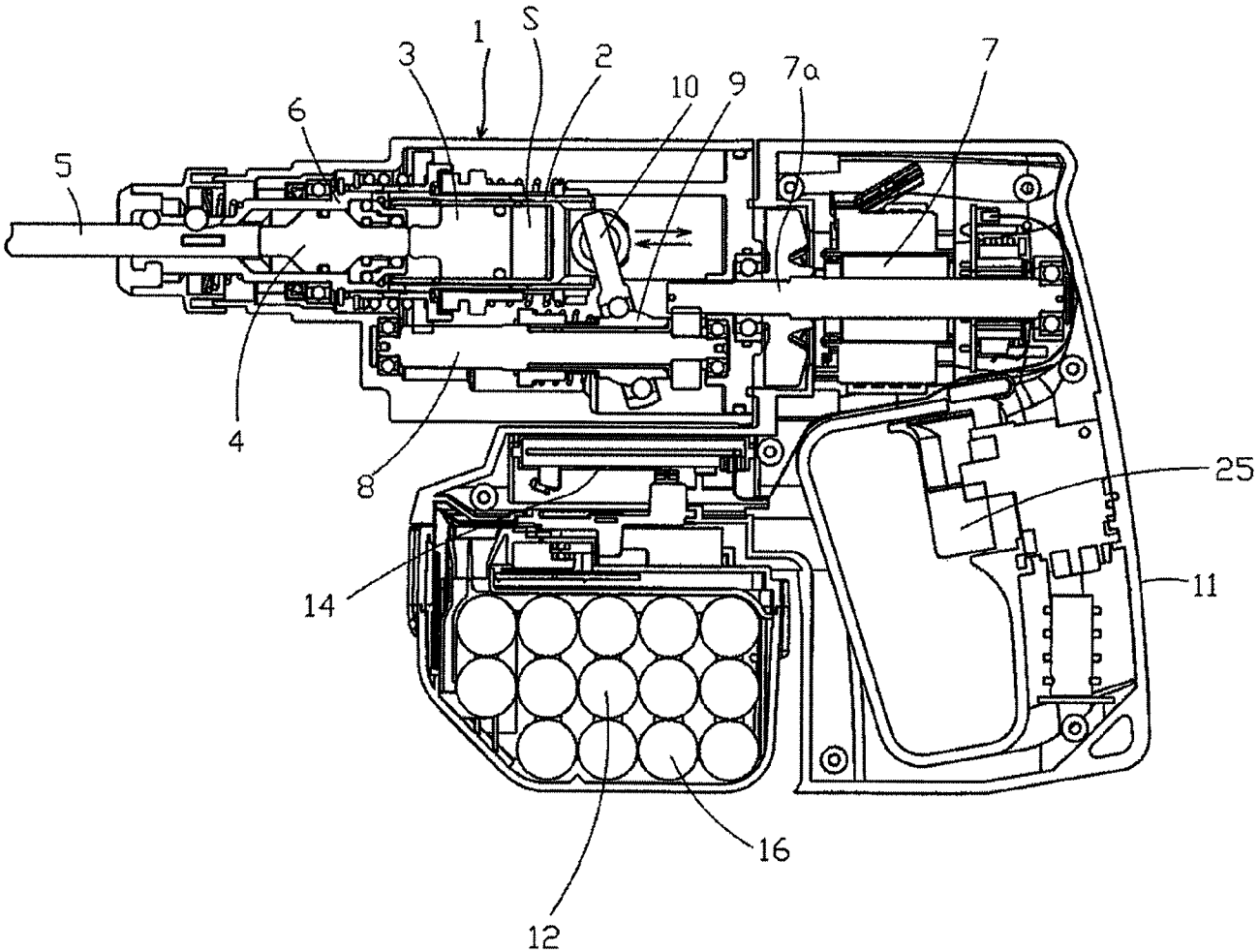
FIG. 1 is a longitudinal section view of the main portions of the internal structure of an electric tool according to the invention.

FIG. 1 is a longitudinal section view of the main portions of a hammer drill. In FIG. 1, reference numeral 1 designates the tool main body of the hammering tool. The tool main body 1 includes therein: a cylindrical-shaped bottomed piston 2 capable of reciprocating; a hammering member 3 disposed slidably within the piston 2; an intermediate member 4 to which is transmitted the driving force of the hammering member 3 capable of carrying out its driving motion in linking with variations in the air pressure of an air chamber S formed between the piston 2 and hammering member 3 due to the back-and-forth reciprocating motion of the piston 2; and, a top end tool 5 to which the driving force is transmitted through the intermediate member 4. The piston 2, intermediate member 4 and top end tool 5 are slidably stored in a cylinder 6.

A motor 7 is stored in the rear portion of the tool main body 1, while the output shaft 7*a* of the motor 7 is meshingly engaged with an intermediate shaft 8. On the outer surface of the intermediate shaft 8, there is rotatably mounted a motion converting member 9 which is structured such that it can be rotated when the intermediate shaft 8 is rotated. The rear end of the piston 2 is connected through an oscillatory shaft 10 to the motion converting member 9 which is mounted on the outer surface of the intermediate shaft 8. Thus, when the motion converting member 9 is rotated, the rotation thereof is converted to the back-and-forth oscillatory motion of the oscillatory shaft 10.

That is, when the motor 7 is rotated, the rotation force thereof is transmitted from the output shaft 7*a* to the intermediate shaft 8. The rotation force of the intermediate shaft 8 is transmitted to the motion converting member 9. As the motion converting member 9 rotates, the oscillatory shaft 10 is oscillated in the back-and-forth direction and the back-and-forth oscillatory motion of the oscillatory shaft 10 is further converted to the reciprocating motion of the piston 2. Since, when the piston 2 reciprocates, the air pressure of the air chamber S existing in the rear of the internal hammering member 3 is varied, the hammering member 3 is also allowed to carry out its driving motion in linking with such variations in the air pressure, thereby applying its driving force to the intermediate member 4. And, the driving force is further transmitted through the intermediate member 4 to the top end tool 5 disposed in the front portion of the piston 2, whereby the top end tool 5 can hole or break its target member such as concrete or stone against which the top end tool is pressed.

Here, although the details of the internal mechanism of the hammer drill are omitted, in the hammer drill, it is possible to choose between a rotation/driving mode in which the top end tool 5 drives while rotating and a driving mode in which the top end tool 5 does not rotate but only carries out its hammering operation.

Next, a power battery 12 for supplying power to the motor 7 is disposed in front of a grip 11. That is, the inside of the tool main body 1 must be able to include not only a space in which the piston 2, intermediate member 4 and top end tool 5 can be disposed in series in the back-and-forth direction as described above, but also, in the rear of the piston 2, a space in which the piston 2 can be reciprocated in the back-and-forth direction. Therefore, the tool main body 1 is inevitably long in the-back-and-forth direction due to the structure thereof. This structure produces an extra space in the lower portion of the tool main body 1. In view of this, the power battery 12 is disposed using extra space. Also, since the whole height of the tool main body 1 is determined by the motor 7, grip 11 and the like respectively existing in the rear portion of the tool main body 1, there is generated a dead space between the tool main body 1 and power battery 12. Therefore, the control substrate (a control device 14 which will be discussed later) of the motor 7 may be disposed in such dead space. Owing to this, the whole of the tool can be made compact.

Next, since the above-mentioned hammer drill carries out its high speed hole drilling operation efficiently, at a stage where the rotation speed of the motor 7 is increased to thereby increase the hole drilling speed, the balance of the air spring within the air chamber S is lost, whereby the hole drilling speed is lowered suddenly. Correspondingly to this, using a measuring device 13 which will be discussed later, the limit number of times of hammering of the hammer drill, where such hole drilling speed is lowered, is measured; and, the control device 14 is used to control the motor 7 such that the number of rotations of the motor 7 can be constant just before the limit number of times of hammering.

Figure 2:
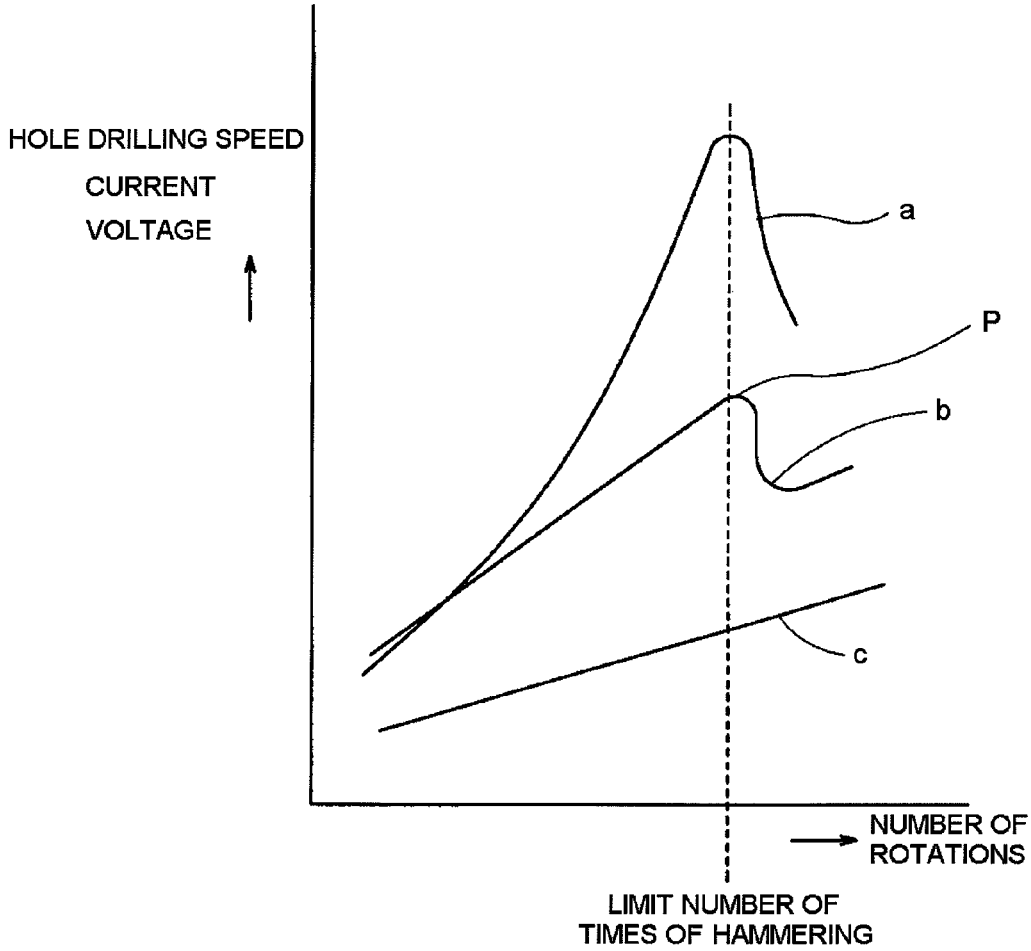
FIG. 2 is a graphical representation to explain the relationship between a hole drilling speed and a drive current respectively corresponding to the rotation of a motor.

That is, as shown in FIG. 2, when the voltage (curved line c) applied to the motor 7 (brushless motor) is increased, the hole drilling speed (curved line a) increases almost in proportion to the number of rotations of the motor 7 but the hole drilling speed is lowered suddenly with the limit number of times of hammering as its peak speed. It is known that variations in the hole drilling speed correspond to variations in a current (curved line b) flowing in the brushless motor 7 and, when the current variations goes beyond its inflection point P, the hole drilling speed is also lowered suddenly. In view of this, in the present hammer drill, such current variations are monitored using the measuring device to detect that the current value is changed from its rising state to its falling state, thereby being able to determine that the rotation number of the motor exceeds the limit number of times of hammering.

Figure 3:
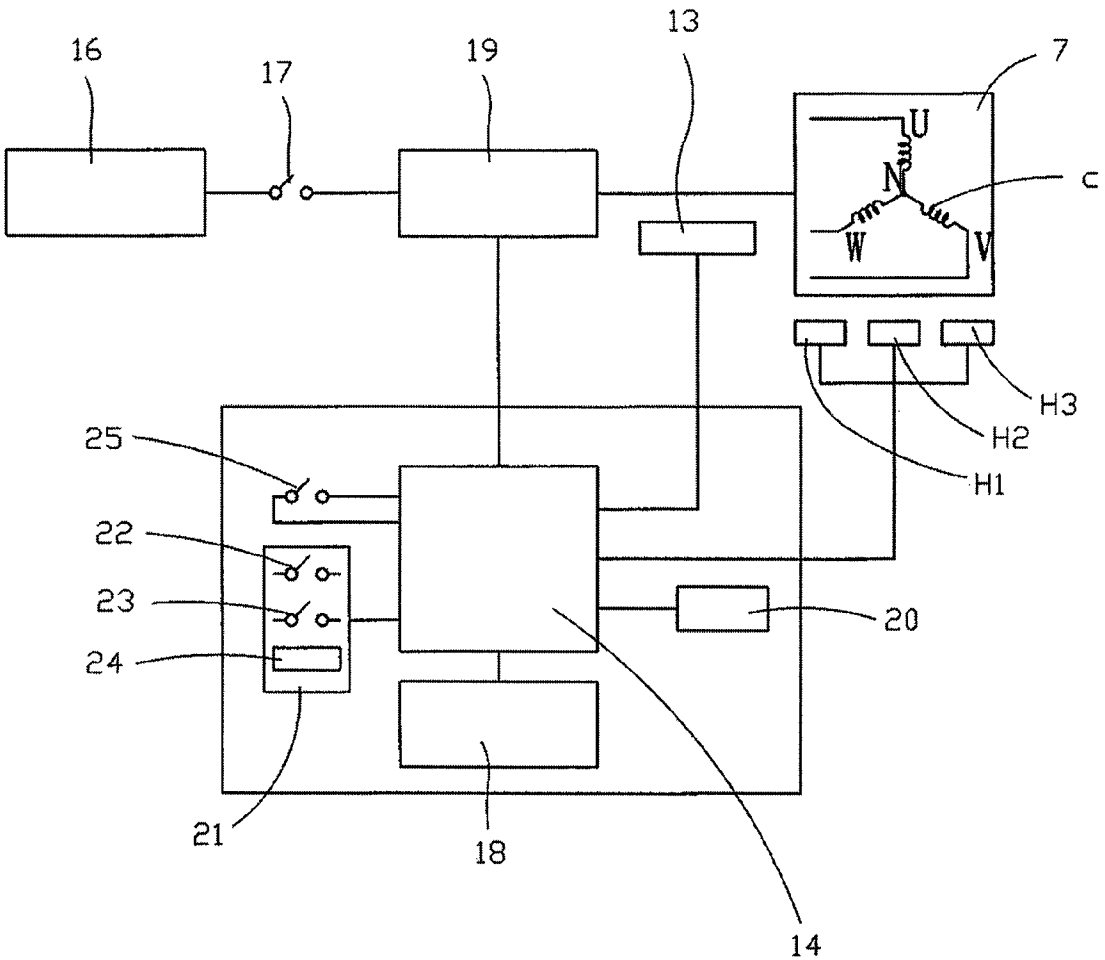
FIG. 3 is a block diagram of the electric tool.

FIG. 3 is a block diagram of the hammer drill. In FIG. 3, reference numeral 13 designates a measuring device, 14 a control device, 25 a trigger switch, 16 a battery pack of the power battery, 17 a main switch, 18 a DC-DC converter for converting a voltage supplied from the battery pack 16 to a voltage which can be operated by the control device 14, and 19 an inverter circuit for driving the motor 7, respectively.

The measuring device 13 is used to measure the value of the drive current of the motor 7. Also, this measuring device 13 may be composed of a resistor element and a drive current flowing in a circuit may be found from the terminal voltage of this resistor element. Further, as the measuring device 13, there may be used a Hall element type current sensor or the like which measures a magnetic flux generated due to a current flowing in a circuit to thereby find a drive current. The measurement results obtained by the measuring device 13 are input to the control device 14.

The control device 14 is made of a microprocessor and monitors the drive current of the motor 7 according to a control program resident in a memory built in the control device 14. Further, the control device 14 controls a drive signal for driving a switching element (for example, a power transistor) for controlling a voltage to be applied to the stator coil of the motor 7, thereby controlling the rotation speed, operation and stop of the motor 7.

The motor 7 is a brushless motor which is small in size but can provide a high performance and, specifically, the number of rotations of which can be controlled freely. The brushless motor 7 detects the rotation position of a rotor using Hall sensors H1 to H3. According to the detect results of the Hall sensors H1 to H3, the control device 14 outputs a drive signal to the inverter circuit 19 and applies a drive current to U-phase, V-phase and W-phase stator windings C to thereby generate a magnetic field; and thus, the control device 14 allows the thus generated magnetic field and a permanent magnet provided on the rotor to attract and repel each other repeatedly, thereby rotating the rotor. The brushless motor may be a motor of a conventionally known type.

The control device 14, according to a timer signal from a timer circuit 20, samples the values of the drive current flowing in the motor 7 whenever a unit time (for example, about one second) passes, and thus monitors variations in the drive current values from the drive current value sampled just before and the drive current value being sampled currently.

As the number of rotations of the motor 7 is increased, the speed of the reciprocating motion of the piston 2 increases in proportion to the rotation of the motor 7. Since the number of times of hammering of the hammering member 3 increases, the hole drilling operation is progressed at a high speed. And, the hammering member 3 shortly becomes unable to follow the motion of the piston 2. As shown by the characteristic curved line in FIG. 2, when the hole drilling speed (curved line a) exceeds the limit number of times of hammering, it drops suddenly. At the then time, the hammering operation of the hammering member 3 becomes poor and thus the driving output thereof is lowered, whereby a load applied to the motor is lowered. Because of this, the drive current value (curved line b) is also similarly lowered. The control device 14 monitors variations in the drive current value measured each unit time and, when the drive current value goes below the current value measured just before, the control device 14 determines that the number of rotations of the motor exceeds the inflection point P of the curved line b, that is, the limit number of times of hammering.

Also, according to the method for grasping the limit number of times of hammering of the hammer drill, when the value of the drive current of the motor 7 goes below the value of the drive current measured just before, it is determined that the number of rotations of the motor 7 exceeds the limit number of times of hammering. In this case, the number of rotations of the motor 7 may be reduced gradually down to the number just before the limit number of times of hammering, and such number may be maintained constant, whereby the hammering member 3 can be driven at the number of times of hammering that can provide the highest efficiency.

Here, in FIG. 3, reference numeral 21 designates a rotation number adjusting device which is used to manually adjust the rotation of the motor 7 without using the measuring device 13. This rotation number adjusting device 21 may include a driving number reducing button 22, a mode switching button 23 and a display 24 for displaying the states of the buttons thereon; and, the device 21 may be provided on the side surface or the like of the tool main body 1.

Figure 4:
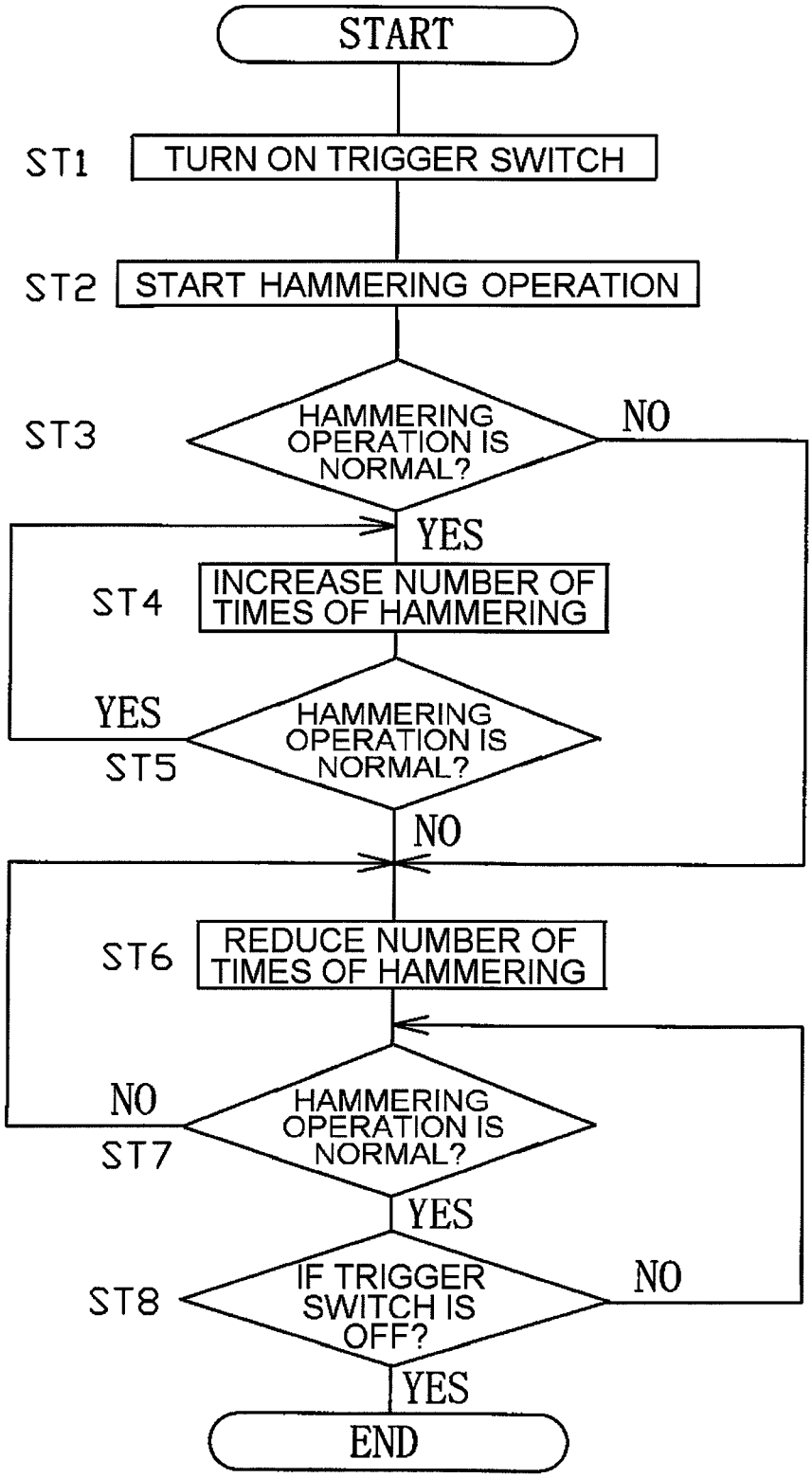
FIG. 4 is a flow chart to explain the operations of the electric tool.

Next, description will be given below of the operation of the above-mentioned electric tool with reference to a flow chart shown in FIG. 4.

When the trigger switch 25 is turned on (Step ST1), the motor 7 is rotated, whereby the hammering operation of the hammering member 3 is started (Step ST2). As the number of rotations of the motor 7 increases, it is checked whether the hammering operation is normal or not, that is, the number of times of hammering is less than the number of rotations of the motor 7 or not (the current value is larger than the current value measured just before or not) (Step ST3). When it is determined that the hammering operation is normal (the former current value is larger than the latter current value), the processing goes to Step ST4, where the number of rotations of the motor 7 is increased. In Step ST5, it is checked again whether the hammering operation is normal or not and, when the normal driving is found, the processing goes back to Step ST4, where the number of times of hammering is increased further and the processes in Steps ST4 and ST5 are carried out repeatedly until the hammering operation becomes not normal.

In Step ST5, when the hammering operation becomes not normal (the then current value becomes lower than the current value measured just before), it is determined that the number of rotations of the motor 7 exceeds the limit number of times of hammering, and thus the processing goes to Step ST6. By lowering the voltage applied to the motor 7 and measuring again the current value each unit time, it is checked whether the hammering operation is normal or not (whether the current value measured later exceeds the current value measured just before or not) (Step ST7). When the hammering operation is found not normal, the processing goes back to Step ST6, where the voltage applied to the motor 7 is lowered further and it is similarly checked again whether the hammering operation is normal or not. This step is carried out repeatedly. And, when it is found that the hammering operation becomes normal, the processing goes to Step ST8, where it is checked whether the trigger switch 25 is on or not. When it is found that the trigger switch 25 is on, the processing goes back to Step ST7, where it is checked again whether the hammering operation is normal or not. The hammering operation is continued until the trigger switch 25 turns off.

As described above, when the trigger switch 25 is pulled to thereby start the hammering operation of the hammering member 3, the control device 14 increases the number of rotations of the motor 7 until it exceeds the limit number of times of hammering to thereby search the limit number of times of hammering. When the number of rotations of the motor 7 exceeds the limit number of times of hammering, the control device 14 lowers the number of rotations of the motor 7 and maintains the rotation of the motor 7 just before the limit number of times of hammering; and, when, during the rotation of the motor 7, the number of rotations of the motor 7 exceeds the limit number of times of hammering, the control device 14 corrects the rotation of the motor 7 again. That is, the control device 14 searches the stable rotation of the motor 7 in order to be able to maintain the number of times of hammering of the top end tool 5 always in the vicinity of the limit number of times of hammering. By rotating the motor 7 at a high speed, that is, by controlling the rotation of the motor 7 such that it is always maintained near to the limit number of driving, the efficiency of the hammering operation can be enhanced. Further, use of the brushless motor 7 can reduce the size and weight of the hammer drill.

Also, although the present embodiment includes the step of searching the limit number of times of hammering by increasing the number of rotations of the motor gradually, this effect can also be expected similarly by using the following flow: that is, the motor is operated at the number of rotations that can provide a previously expected hole drilling speed and, when there is generated a poor hammering operation, or when there is detected a case where a poor hammering operation seems to occur, the number of rotations of the motor is lowered.

For the above-mentioned electric tool, description has been given heretofore of a case where the drive current of the motor 7 is measured to automatically grasp the limit number of times of hammering and the motor 7 is rotated stably just before the limit number of times of hammering. However, alternatively, an operator may actually judge the condition of a member to be driven or the shape of the top end tool 5 to adjust the speed of the motor; or, the operator may operate the top end tool 5 actually and, at the time when there is generated a poor hammering operation, the operator may adjust the rotation of the motor 7 manually. The rotation number adjusting device 21 for adjusting the number of rotations of the motor 7 may include the driving number reducing button 22 which can be pressed and operated by the operator when the operator confirms the poor hammering operation, and the mode switching button 23 for reducing the number of times of hammering in order to prevent the breakage of the top end tool 5 having a small diameter or to prevent the breakage of the concrete; and, the device 21 may further include the display 24 which is used to display the states of these buttons thereon.

The present invention has been described heretofore in detail and with reference to the specific embodiment thereof. However, it is obvious to a person skilled in the art that various changes and modifications are possible without departing from the spirit and scope of the invention.

The present patent application is based on the Japanese Patent Application (Patent Application No. 2007-149431) filed on Jun. 5, 2007 and thus the contents thereof are incorporated herein for reference.

INDUSTRIAL APPLICABILITY

The present invention can provide a high-performance hammering tool which, by controlling the number of rotations of a motor to maintain the number of times of hammering of the tool always near to the limit number of times of hammering of the tool, can increase the number of times of hammering up to the limit number to thereby enhance the efficiency of the hammering operation of the tool. Also, the present hammering tool is small in size and weight but can provide excellent driving performance.

The invention claimed is:

1. A hammering tool comprising:

a tool main body;

a motor;

a piston which reciprocates by using the motor as a drive force; and a hammering member which carries out its hammering operation in linking with a reciprocating motion of the piston, wherein the tool main body includes a measuring device which measures a driving state of the tool and a control device which controls the number of rotations of the motor, the control device controls the number of rotations of the motor according to measurement results of the measuring device, and the control device, from the measurement results of the measuring device, determines the limit number of times of hammering where the hammering member becomes unable to follow the reciprocating motion of the piston, thereby controlling the number of rotations of the motor.

2. The hammering tool according to claim 1, wherein the measuring device measures a drive current value of the motor, and the control device monitors variations in the drive current value and, when the drive current value is lowered, reduces the number of rotations of the motor.

3. The hammering tool according to claim 2, wherein the control device samples the drive current value every unit time and monitors variations in the drive current value from a drive current value sampled just before and a drive current value currently sampled.

4. The hammering tool according to claim 1, further comprising:

an intermediate member which transmits a hammering force of the hammering member to a top end tool mounted on a top end of the tool main body, wherein the tool main body includes the measuring device which measures a hammering state of the hammering member.

5. The hammering tool according to claim 1, wherein the measuring device measures the drive current value of the motor, and the control device monitors variations in the drive current value and, when the drive current value is lowered, determines that the number of rotations of the motor exceeds the limit number of times of hammering.

6. The hammering tool according to claim 5, wherein the control device samples the drive current value every unit time and monitors variations in the drive current value from a drive current value sampled just before and a drive current value currently sampled.

7. The hammering tool according to claim 5, wherein the control device increases the number of rotations of the motor until the number of rotations of the motor exceeds the limit number of times of hammering to thereby search the limit number of times of hammering, when the number of rotations of the motor exceeds the limit number of times of hammering, the control device reduces the number of rotations of the motor and maintains the number of rotations of the motor just before the limit number of times of hammering, and when the number of rotations of the motor exceeds the limit number of times of hammering again during the rotation of the motor, the control device corrects the number of rotations of the motor again to thereby search the limit number of times of hammering in such a manner that the number of times of hammering is always maintained in the vicinity of the limit number of times of hammering.

8. A hammering tool comprising:

a tool main body;

a motor;

a piston which reciprocates by using the motor as a drive force;

a hammering member which carries out its hammering operation in linking with a reciprocating motion of the piston;

an intermediate member which transmits a hammering force of the hammering member to a top end tool mounted on a top end of the tool main body; and a rotation number adjusting device which sets the number of rotations of the motor according to the limit number of times of hammering where the hammering member becomes unable to follow the reciprocating motion of the piston, wherein the rotation number adjusting device is operated manually.

* * * * *